US005907117A

United States Patent [19]

Persson et al.

[11] Patent Number: 5,907,117

[45] Date of Patent: May 25, 1999

[54] METHOD AND DEVICE FOR USING WARHEADS RELEASED FROM A LAUNCHING VEHICLE TO COMBAT TARGETS IDENTIFIED ALONG THE FLIGHT PATH OF THE LAUNCHING VEHICLE

[75] Inventors: Per-Olof Persson, Karlskoga; Lars Paulsson, Kristinehamn; Stig Johnsson, Karlskoga, all of Sweden

[73] Assignee: Bofors AB, Karlskoga, Sweden

[21] Appl. No.: 08/836,572

[22] PCT Filed: Nov. 16, 1995

[86] PCT No.: PCT/SE95/01300

§ 371 Date: Nov. 6, 1997

§ 102(e) Date: Nov. 6, 1997

[87] PCT Pub. No.: WO96/15422

PCT Pub. Date: May 23, 1996

[30] Foreign Application Priority Data

Nov. 16, 1994 [SE] Sweden ..... 9403942

[51] Int. Cl.[6] ..... F42B 12/60

[52] U.S. Cl. ..... 89/1.11; 102/388; 102/489; 244/3.1; 244/3.15; 244/3.27

[58] Field of Search ..... 89/1.11, 1.54; 102/357, 387, 388, 489, 393; 244/3.1, 3.15, 3.16, 3.21, 3.24, 3.29, 3.3, 14, 120, 137.4, 190

[56] References Cited

U.S. PATENT DOCUMENTS

| | | | |
|---|---|---|---|
| 3,724,373 | 4/1973 | Rivenes | 244/3.27 |
| 4,383,662 | 5/1983 | Alongi et al. | 244/3.15 |
| 4,522,356 | 6/1985 | Lair et al. | 244/3.15 |
| 4,530,270 | 7/1985 | Danaci | 89/1.11 |
| 4,553,718 | 11/1985 | Pinson | 244/3.15 |
| 4,601,442 | 7/1986 | Friedel et al. | 244/3.24 |
| 4,711,178 | 12/1987 | Argyrakis | 102/384 |
| 4,858,532 | 8/1989 | Persson et al. | 102/387 |
| 4,876,963 | 10/1989 | Deffayet | 102/387 |
| 5,094,170 | 3/1992 | Raynaud et al. | 102/489 |
| 5,279,199 | 1/1994 | August | 89/1.51 |
| 5,280,752 | 1/1994 | Borgstrom et al. | 102/384 |
| 5,282,422 | 2/1994 | Borgstromn et al. | 102/384 |
| 5,301,614 | 4/1994 | Rieger | 102/384 |
| 5,467,681 | 11/1995 | Liberman | 89/1.11 |
| 5,577,431 | 11/1996 | Kusters | 89/1.51 |

FOREIGN PATENT DOCUMENTS

| | | |
|---|---|---|
| 252036 B1 | 1/1988 | European Pat. Off. . |
| 424198 A1 | 4/1991 | European Pat. Off. . |
| 33 45 601 A1 | 6/1985 | Germany . |
| 41 33 405 C2 | 4/1993 | Germany . |
| 2 136 931 | 8/1983 | United Kingdom . |
| WO 94/23265 | 10/1994 | WIPO . |
| WO 94/23266 | 10/1994 | WIPO . |

*Primary Examiner*—Charles T. Jordan
*Assistant Examiner*—Christopher K. Montgomery
*Attorney, Agent, or Firm*—Pollock, Vande Sande & Amernick

[57] ABSTRACT

The present invention relates to a method and device for combating identified targets (F) using warheads (2) from a launching vehicle (1) flying over a target area, by separating from this launching vehicle (1) warheads (2) which act independently after separation, and including those targets which lie close to the flight trajectory of the launching vehicle (1) and those which lie well to the side of same flight trajectory. The invention is based on the use of that part of the kinetic energy of the launching vehicle (1) which the warhead (2) takes over from the same when it is separated in order to give the warhead (2) a looping trajectory or any other programmed flight trajectory, which carries it up to a starting height adapted to its active use, which lies considerably above the actual flight trajectory of the launching vehicle (1), and which, if so required, can carry the warhead (2) back to the geographical position where it was separated from the launching vehicle (1). The action of the warhead (2) can then follow guidelines known per se.

10 Claims, 4 Drawing Sheets

METHOD AND DEVICE FOR USING WARHEADS RELEASED FROM A LAUNCHING VEHICLE TO COMBAT TARGETS IDENTIFIED ALONG THE FLIGHT PATH OF THE LAUNCHING VEHICLE

The present invention relates to a method and a device for using warheads from a launching vehicle flying over a target area, such as a bomb casing of the cruise missile type, RPV (remotely piloted vehicle) or equivalent, with the warheads separating from the launching vehicle and then acting independently, in order to combat identified hard targets such as armoured vehicles, artillery, bunker positions etc. This includes those targets which lie extremely close to the flight path of the launching vehicle and which, for this reason, have perhaps been identified only at very close quarters, and also those targets which lie to the side of the flight path.

The so-called cruise missiles with navigation systems which are independent of external command after initiation, and with extremely long ranges, were originally designed for navigating at very low cruising altitudes along predetermined and programmed flight paths to break through the oppositions missile defenses and to carry individual large charges towards particularly important selected targets which are well defended against air attack. However, developments have been made towards using the same basic concept for somewhat different purposes, often in a somewhat simpler and less expensive design with shorter ranges. Aircraft-like weapon carriers of the simplified cruise missile type have been proposed for defending against attacks of enemy tanks by deploying antitank mines or independently acting sub-munitions over an area. The area could be predetermined before initiation of the launching vehicle in question or identified during its flight by a target seeker arranged in the same and an analysis unit coupled thereto.

In order to make it as difficult as possible for the opposition side to combat these weapons carriers which are extremely expensive, they have been given, in the same way as the original cruise missiles, a very low cruising altitude towards the intended target area. This makes it possible for launching vehicles of this type to approach the target under the protection of the radar shadow which usually occurs at cruising altitudes of less than about 50 meters. At the same time this means that the actual target seeker, if the launching vehicle in question is provided with one, is only able to give very short warning times for offloading of weapons against those identified targets which lie behind concealing terrain formations or extremely close to the actual flight path. In addition, if the targets are ones which lie close to the flight path, but well to the side thereof, weapons offloading is made correspondingly more difficult.

Warhead types which will be very useful deployed from a launching vehicle of the type in question here are those which are provided with their own target seeker and which, as they descend with deceleration towards ground level from a certain height, scan a defined ground area below them along a helical trajectory centered on the line of descent. The target seeker fires its ammunition of the shaped charge type or equivalent when it finds that the direction of action of the ammunition covers a combatable target. European Patent 0 252 036, for example, describes a warhead of this type which has its own target seeker and an active part directed in parallel thereto. During its active phase, it rotates about its line of descent, with the sighting line of the target seeker and the direction of action inclined relative to the line of descent, and it additionally has the advantage that because it has no parachute, which is the rule in other warheads of similar function, it in not disrupted by wind conditions prevailing within the target area.

Another type of warhead which could be used in combination with the launching vehicle in question here would be those warheads which are provided with their own target seeker which actively guides the warhead, during the final phase, in towards an identified target and then fires its ammunition at the optimum distance or alternately on direct impact.

One problem which must be solved in connection with the present type of launching vehicle and its basically low cruising altitude is that the warheads, regardless of which of the abovementioned types is chosen, require a higher cruising altitude than that of the launching vehicle in order to be able to act on the target type in question. In WO 94/23266, a method is described for giving warheads of the types indicated above a flight altitude which is sufficiently high in relation to the cruising altitude of the launching vehicle, with the aid of special rocket engines. When the warheads leave the launching vehicle, the rocket engine provide a movement of separation which is directed obliquely rearwards and upwards in relation to the direction of flight and which, combined with the actual speed of the launching vehicle in the direction of flight, results in the warheads being able to act relatively closely ahead of the point where the target was first observed by the target seeker of the launching vehicle. This system depends for its functioning on expensive and space-consuming ejector rockets which both increase the costs of the system and reduce the explosive load, and at the same time it does not always guarantee being able to offload weapons against those targets which are not identified until the launching vehicle is just about to pass alongside or over them.

SUMMARY OF THE INVENTION

The present invention now relates to a method and a device to give warheads separated from a launching vehicle flying at low altitude over a target area, such as a bomb casing of the cruise missile type, RPV or equivalent, a significantly higher flight altitude without any major and undesired changes in length compared to the point where the respective warhead leaves the launching vehicle. It is based on an active use of the kinetic energy of the launching vehicle, which energy is taken over to a corresponding extent by the warhead when the latter leaves the launching. This kinetic energy is used in turn to give the warhead a looping trajectory or any other programmed trajectory, which means that its original trajectory directed forwards in the direction of flight is changed upwards and backwards towards a point with more or less the same geographical coordinates as those where the warhead left the launching vehicle, but at the considerably higher flight altitude which the warhead requires for its active functioning.

To be able to satisfy the basic concept, the sub-munition part needs to have, at least initially, an aerodynamic shape adapted to the desired flight trajectory, i.e. in most cases a more or less aircraft-like shape with aerodynamically designed aerofoils which may be surprisingly small if the shape of the body is in other respects suitably adapted. These aerodynamic aerofoils must be adapted to the desired flight trajectory. This means that they should comprise actively adjustable guide surfaces since the basic principles for use of warheads as regards the lateral direction can vary from one instance to another, and at the same time strong winds can make it necessary to make corrections to the actual flight trajectory both in terms of height and lateral direction. This therefore means that the warhead must be able to be controlled in both roll and yaw, and at the same time it must have its own computer coupled to the gyro, accelerometers etc., which gives the rudder the necessary commands on the basis of information obtained from the bomb casing prior to separation from the latter, and its own calculations made during the trajectory.

The combination of main launching vehicle, such as a bomb casing or the like with its own target seeker, and warheads with their own target seekers for detailed scanning of a defined target area, and the basic principles for the active functioning of the warhead therefore belong to the known start of the art. The method for using a controlled looping trajectory or any other programmed flight trajectory to deliver the warhead at a higher flight altitude than that of the launching vehicle, but in proximity to the geographical point where the warhead left the same, constitutes an embodiment invention. Another embodiment of the invention includes the actual device and the fact that the trajectory of the warhead can be combined with longitudinal and/or lateral guidance in order to give the warhead the best possible starting point in respect of the target which is to be hit.

An embodiment of the invention entails that an actual target may have been identified by a target seeker which is built into the launching vehicle and which issues orders, via built-in operations logics (operations computer) on separation or ejection of the required number of warheads and gives the respective control logics the necessary control data. Alternatively the necessary data on the target is given to the operations computer of the launching vehicle as a program or as remote-control command during its flight towards and over the target area.

The direct separation should be a relatively gentle action in which the warhead is pressed or knocked out of the launching vehicle and upwards or to the side. The aerodynamic aerofoils of the warhead, if these are stored in the launching vehicle and folded against or into the warhead in order to save space, are deployed so that they catch in the air masses swirling past the launching vehicle. In addition, the separation of the warheads from the launching vehicle should take place in a "nose-up" position, since a raised nose position affords quicker in-swing and actively prevents a stalling of the aircraft-like warhead.

A suitable method for activating the separation of the warhead from the launching vehicle is quite simply to lift it out upwards or to the side by means of a linearly inflatable airbag made of laminated Kevlar, for example, arranged under the warhead. The airbag is inflated with, for example, a small propellant charge and in this way lifts out the warhead. If the fully inflated airbag has been given a wedge shape which closes rearwards in the direction of flight, the abovementioned "nose-up" position is automatically obtained. The basic principles for this method for ejecting ammunition components from a launching vehicle are described in EP 0 424 198.

As has already been mentioned above, it will also be possible for the warheads designed in accordance with the invention to be used against targets which are located to the side of the actual flight trajectory. This means that each warhead included in the launching vehicle, and there can be 10 to 20 in each launching vehicle, must be provided with its own control logics which coordinate the lateral and longitudinal guidance during the looping trajectory. This is done on the basis of the control values received via the target seeker of the launching vehicle, and possibly also values obtained from its own gyro, accelerometer etc. which continuously provide information on the current position in the x, y and z direction, and any movements in the air stream. Fuse/arming/ignition functions are also included, of course, in addition to the active part and the actual target seeker.

Once the aerodynamically designed and preferably aircraft-like warhead has left the launching vehicle, it commences its flight trajectory with a short in-swing phase and thereafter follows a looping trajectory, or other preprogrammed trajectory, up to at least the top altitude exclusively as a flight phase.

As soon as the warhead has reached the topmost point of the trajectory, its control logics and its target seeker can take over entirely, and its continued function can principally follow two alternatives depending on the function which has been chosen for the active stage of the warhead.

According to a first embodiment, the warhead can be of the type which is guided in the final phase and in which its own target seeker guides the warhead in directly towards a target identified by the target seeker itself in order to activate the active charge of the warhead at a predetermined distance from the target or on direct impact thereon.

According to a second embodiment, the warhead can be of the type which, during its decelerated descent, scans the area around the impact site along a helical trajectory in towards the impact point, and if its target seeker finds a combatable target within the trajectory, then fires the active charge of the warhead. The basic principle for this type of warhead is described in the previously cited EP 0 252 036 and a development thereof in SE A1-9101038-9.

In order to function in the intended manner, the second type of warhead must, during the active phase as it approaches ground level in a decelerated descent, rotate at a predetermined speed of rotation about its main inertia axis, which will, in turn, form a predetermined angle with the direction of action of the active part and the parallel seeking direction of the target seeker. The angular adjustment of the main inertia axis relative to the direction of action of the warhead is achieved, for example, by deploying the target seeker to the side of the active charge, at the same time an the target seeker is activated, while the decelerated descent and the maintenance of the rotation of the warhead are achieved by means of aerodynamically shaped deceleration surfaces which can preferably be deployed from the warhead in conjunction with the activation thereof. These deceleration surfaces can have, for example, the shape which is shown in SE-A-9101037-1.

Even if the aerodynamic deceleration surfaces of the warhead are designed to maintain the desired rotation about the main inertia axis, it must be assumed that the rotation will be initiated in another more active manner, since otherwise valuable flight altitude would be lost.

Thus, according to an embodiment the invention, the target seeker is deployed to obtain the desired inclination of the main inertia axis relative to the direction of action of the warhead. This can also be assumed to correspond to the line of symmetry of the warhead, since the active part is the one of its components which clearly has the greatest mass. The rotation of the warhead about its main axis of inertia can be activated, for example, by means of nozzle engines, rudder servos, or in another way. This takes place as soon as possible after the warhead has passed the top of the flight trajectory, whereupon the warhead is given the desired rotation combined with the angle of incidence necessary for its function, and a downward speed vector.

Once the aircraft-like warhead containing the active part, target seeker, possibly a gyro, control logics, impulse engines etc., has been rotated up to the desired speed of rotation, there are two alternative courses of action.

Thus, it is possible to retain completely the aircraft-like warhead, if appropriate after separation of wings and/or fins, or else it is possible to use warheads whose outer configuration is more or less identical with the types of warheads mentioned in the patents cited above. In the second case, it is necessary to first remove the aircraft-like outer shell which has been responsible for the flight trajectory, which may advantageously be a looping trajectory. If the aerodynamically designed and preferably aircraft-like outer shell of the warhead is to be removed after the warhead has been given the necessary rotation, angle of incidence and downward speed vector, this must be done without seriously disturbing the rotation. This means that the outer shell should preferably be divided along one or more planes which run parallel to what is at that time the axis of rotation of the warhead.

Provided that the actual warhead which has thus been released, hereinafter referred to as the sub-munition, is of the general type which is described in the previously cited references EP 0 252 036 and SE-9101038-9, it will then comprise an active charge, a deployable target seeker, fuse/arming/ignition devices combined in one unit, and deployable aerodynamic deceleration members. When the target seeker and the deceleration surfaces are deployed, the main inertia axis of the sub-munition will be displaced away from the original line of symmetry. A certain time will be required for this stabilization phase before the sub-munition rotates uniformly about the new position of the main inertia axis, i.e. with the inclination which at ground level gives the helical seeking pattern.

The second alternative thus involves the need for an extra dividing operation and requires that the highest point of the warhead in the looping trajectory lies so high up that the subsequent downward trajectory gives time for both the dividing phase and the stabilizing phase. The advantage is, however, that it is possible to use directly as sub-munition a product which is also included in a number of other weapons carriers.

If the first alternative of allowing the warhead in its entirety to execute both the looping trajectory and the seeking phase/active phase is chosen, then the dividing phase is omitted, although this alternative can involve a greater or lesser number of parts of its purely aerodynamic aerofoils, such as wings and/or fins, being separated off. According to this alternative, the whole warhead, once it has passed the top of the flight trajectory, is quite simply converted to a regular dive in oblique spin. In this case too it is possible to have a deployment of the target seeker to the side of the active charge, which is responsible for the necessary inclination of the main inertia axis of the warhead to the side of what is its axis of symmetry during the flight phase.

Finally, if a warhead is used which is guided entirely by the target seeker after the topmost point of the flight trajectory, then the rotation and dividing phases are dispensed with. Instead the warhead will require an extremely advanced target seeker, control logics and guidance members which are also able to cope with substantial course alterations.

For the user, the present invention, with its various embodiments, involves clear advantages compared with previous systems since it can be used both against those targets which are only identified very close to the flight trajectory of the launching vehicle and also those targets which are identified only when the bomb casing is passing time. In both of these alternatives, it is also possible to combat those targets which lie well to the side of the flight trajectory of the launching vehicle.

BRIEF DESCRIPTION OF THE DRAWINGS

The invention has been defined in the patent claims which follow and it will now be described in somewhat greater detail with reference to the attached figures, in which:

DETAILED DESCRIPTION OF THE INVENTION

The launching vehicle shown in FIG. 1 and FIGS. 5 to 7 in the form of the bomb casing 1 is intended to be a completely autonomous battle system in the form of a projectile. It is driven by a turbojet engine and has its own integrated navigation system (control logic) which can be pre-programmed, and an internal target seeker which is coupled to the control logic. A number of warheads 2 are stationed in the projectile. As is evident from FIG. 1, these are in two rows. The direction of ejection is assumed in this case to be upwards, for which reason the top plate of the bomb casing can be thrown off. Under each warhead 2 there is an airbag 3 which is empty in the rest position and which can be inflated by its own propellant gas charges. In the fully inflated state, these airbags have a distinct wedge shape, with the highest part at the front in the direction of flight of the bomb casing.

When the airbag 3 lying under the warhead to be ejected is inflated, the warhead 2 is lifted relatively gently out of its position, with the wedge shape of the airbag ensuring that the warhead 2 leaves the bomb casing 1 with the nose distinctly raised. This, combined with the deflection of the rudder of the bomb casing 1, and combined with the kinetic energy relative to the surrounding air which the warhead takes over from the bomb casing, initiates the looping trajectory of the warhead, which is an important feature of the present invention.

Figure 1:
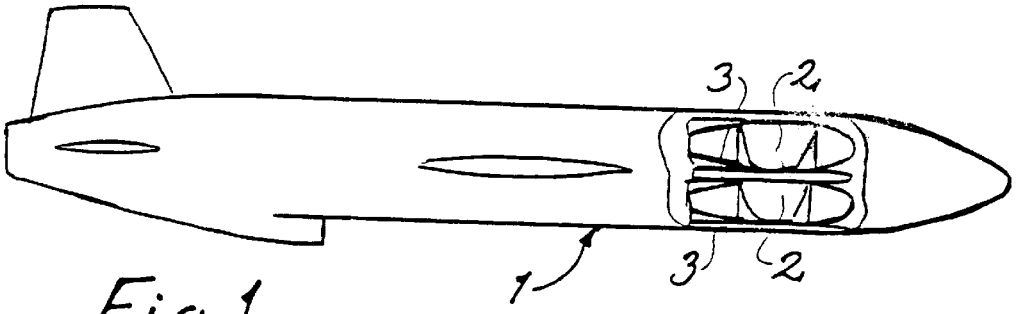
FIG. 1 shows a side view, in partial cross-section, of the bomb casing in conjunction with the invention.
Figure 2:
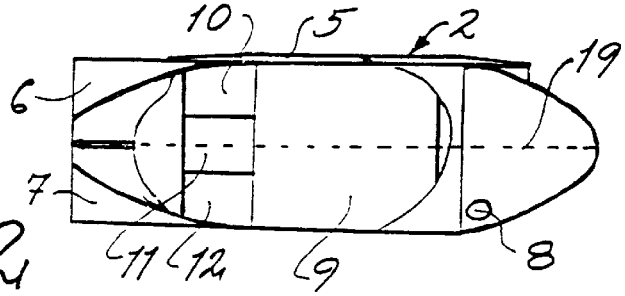
FIG. 2 shows a side view, in partial cross-section, of the aerodynamically designed warhead.
Figure 3:
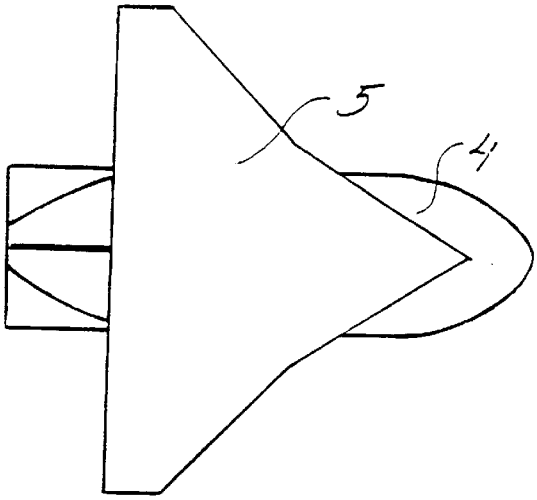
FIG. 3 shows the warhead according to FIG. 2 as seen from above, and with wings spread.
Figure 4:
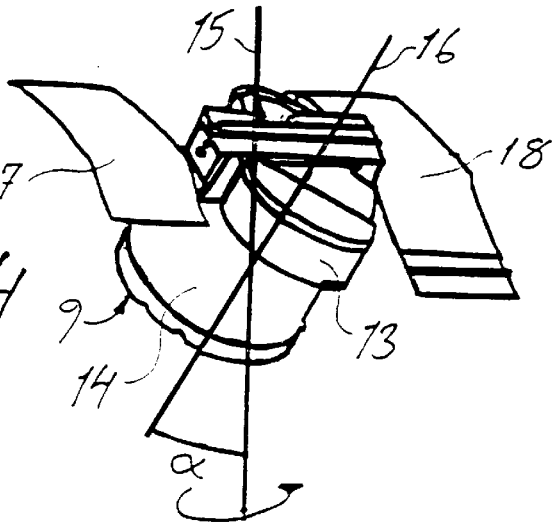
FIG. 4 is an oblique projection of the sub-munition which, in accordance with an embodiment of the invention, can be released from the warhead according to FIGS. 2 and 3, and FIGS. 5 to 7 are schematic representations of the operational sequences for the device according to the invention, with its three different alternative embodiments as regards the warheads themselves.

The warhead 2, shown in more detail in FIGS. 2 and 3, has a compact shape, but one which is still well suited to its flight task. These short and thick projectiles 4 are provided on the top side with a wing 5 of broken delta shape, and have at their rear and movable side and height rudders 6 and 7, respectively. In its rest position, the wing 5 can be folded in around the projectile. This has been made possible by means of a hinge and by the wing being made of titanium. This results in the wing moving a good deal during the flight, which fact has been taken into consideration when designing the wing. At the front part of the warhead there are also one or more rocket engines 8 which are intended to be used for rotating the warhead into a spin. FIG. 2 also shows the main components accommodated in the interior of the warhead, namely an active part or in this case a complete sub-munition 9 (cf. FIG. 4), a gyro 10, one or more accelerometers 11, and the rudder servo 12. The sub-munition 9 includes an active charge 14 and the warhead's own target seeker 13. These and other components included in the sub-munition are shown in FIG. 4. The active charge 14 in of the shaped charge type (RSV IV). The target seeker 13 being deployed to the side of the line of symmetry 16 of the active charge and of the whole sub-munition, provides for the shifting of the main inertia axis 15 of the sub-munition, which gives the desired angle a to the line of symmetry 16. The sub-munition also includes the two deployable aerodynamic aerofoils 17 and 18.

Figure 5:
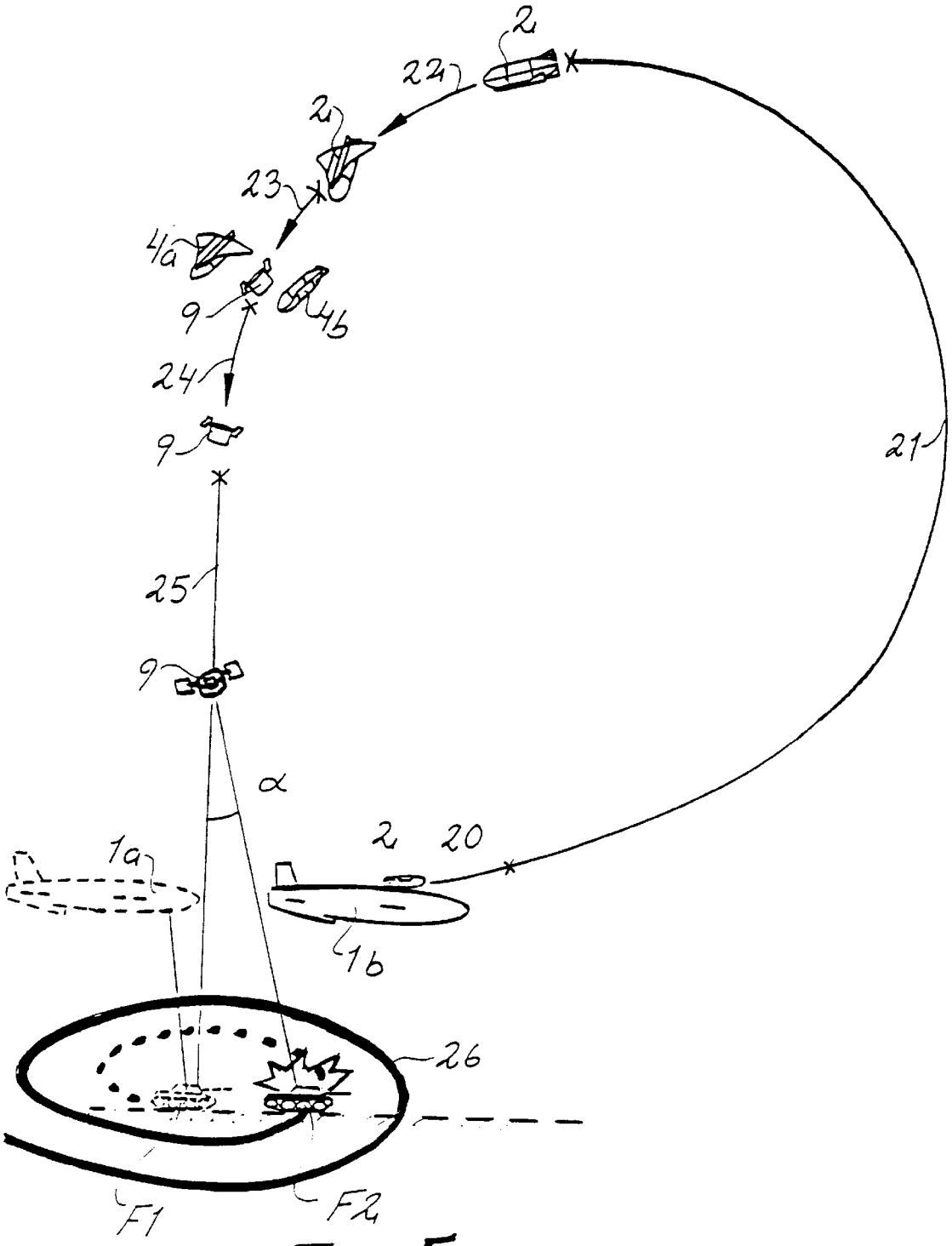

Although the warhead shown in FIGS. 2 and 3 is of the type which follows the functional sequence shown in FIG. 5, and therefore divides once it has been converted to a dive spin and thus releases the sub-munition 9 shown in FIG. 4, a projectile designed in the same way can in principle also be used for the two other alternative functional sequences in accordance with the invention.

When no dividing takes place, the actual target seeker of the warhead can be deployed through an opening in the projectile. The members necessary for the dividing of the projectile, which is preferably effected in the longitudinal direction, have not been depicted, except for the fact that a longitudinal dividing line 19 has been indicated with a broken line in FIG. 2.

The complete functional sequence, shown in FIG. 5, for the first embodiment of the device according to the invention entails that the incoming bomb casing 1*a* with its built-in target seeker identifies an enemy target at position F1, whereupon a warhead 2 is given target information and a start command. When the bomb casing has reached position 1*b*, the associated airbag 3 has been inflated and has lifted the warhead 2 out to the start position. The nose-up position of the warhead 2, the kinetic energy of the latter and the action of the rudders 6, 7 mean that after a swing-in phase 20, the warhead executes its looping trajectory or flight phase 21 in accordance with the invention. During the flight trajectory 21, the control logic of the warhead executes possible lateral and longitudinal correction of the trajectory on the basis of, on the one hand, the information on the lateral position F1, F2 of the target in relation to the flight trajectory of the bomb casing 1, the movements of the target etc., which it obtains from the target seeker of the bomb casing before the ejection, and on the other hand the movements in the air stream which it observes itself during the flight, and whose effect on the flight trajectory receives correction. Once the warhead has passed the top point of the trajectory, the rocket nozzles 8 (there may be several of these) at the front part of the warhead are activated, and it is rotated into a spin with the speed of rotation necessary for continued operation. The warhead is thus converted in principle to a spinning dive during this rotation phase 22.

In the present embodiment of the invention, the dividing phase 23 is then initiated and executed, with the projectile 4 of the warhead 2 being divided along the line 19 by means of propellant charges, spring locks being released, or in another way. The sub-munition 9 is freed in this way, and it is now given the opportunity to deploy its target seeker 13 and the aerofoils 17 and 18. After a stabilizing phase, the warhead initiates and executes its active seeking and action phase 25 during which, rotating about its greatest inertia axis coinciding with the line of fall and plumbline 15, it scans the ground level below it along a helical trajectory. The helical trajectory 26 is the path on the ground followed by the target seeker of the sub-munition and also the path followed by the direction of action of its active change 14 when ignited. The target seeker and the active charge parallel thereto forming an angle according to the invention with respect to the line of fall and plumbline. In the alternative shown in the figure, the target seeker 13 of the sub-munition finds the target at the point F2 to which the target has travelled during this time, whereupon the active charge 14 is activated and the target eliminated.

Figure 6:
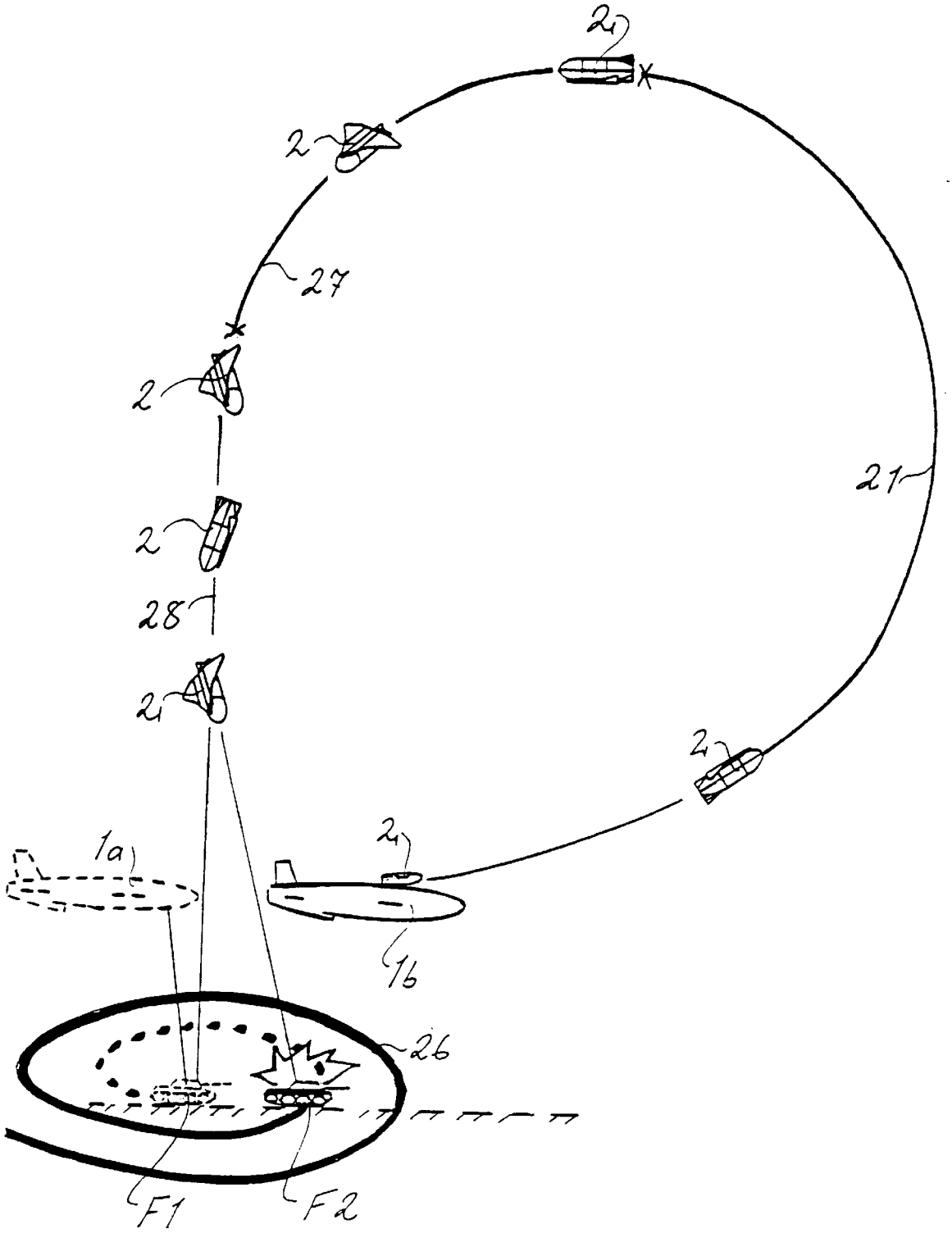

The alternative shown in FIG. 6 follows the same functional sequences as the previous alternative, both at the start and through a large part thereof, but with the exception that the dividing phase in dispensed with. The target seeker of the bomb casing 1 thus identifies the target at point F1, gives the warhead 2 the start order, and thus executes the looping trajectory 21 in a corresponding manner. A rotation phase 22 is then executed, which also includes a shifting of the maximum inertia axis of the warhead by deployment of the actual target seeker. After a necessary stabilizing phase, which can also be included in this phase, the warhead is thus diving in a spin, rotating about the line of descent which in oblique relative to its own axis of symmetry. This phase 28 is thus the seeking and action phase of the warhead, during which it scans the ground level below it along a corresponding helical trajectory 26 until it finds the target at the point F2 and then activates its active charge. During the active phase 28, it may be necessary to provide the warhead with air brakes, on the one hand in order to keep the movements of the warhead in the spin dive as uniform as possible during the whole seeking and action phase, and on the other hand to give it a sufficient action time. Quite simply, it must not be allowed to descend too quickly.

Figure 7:
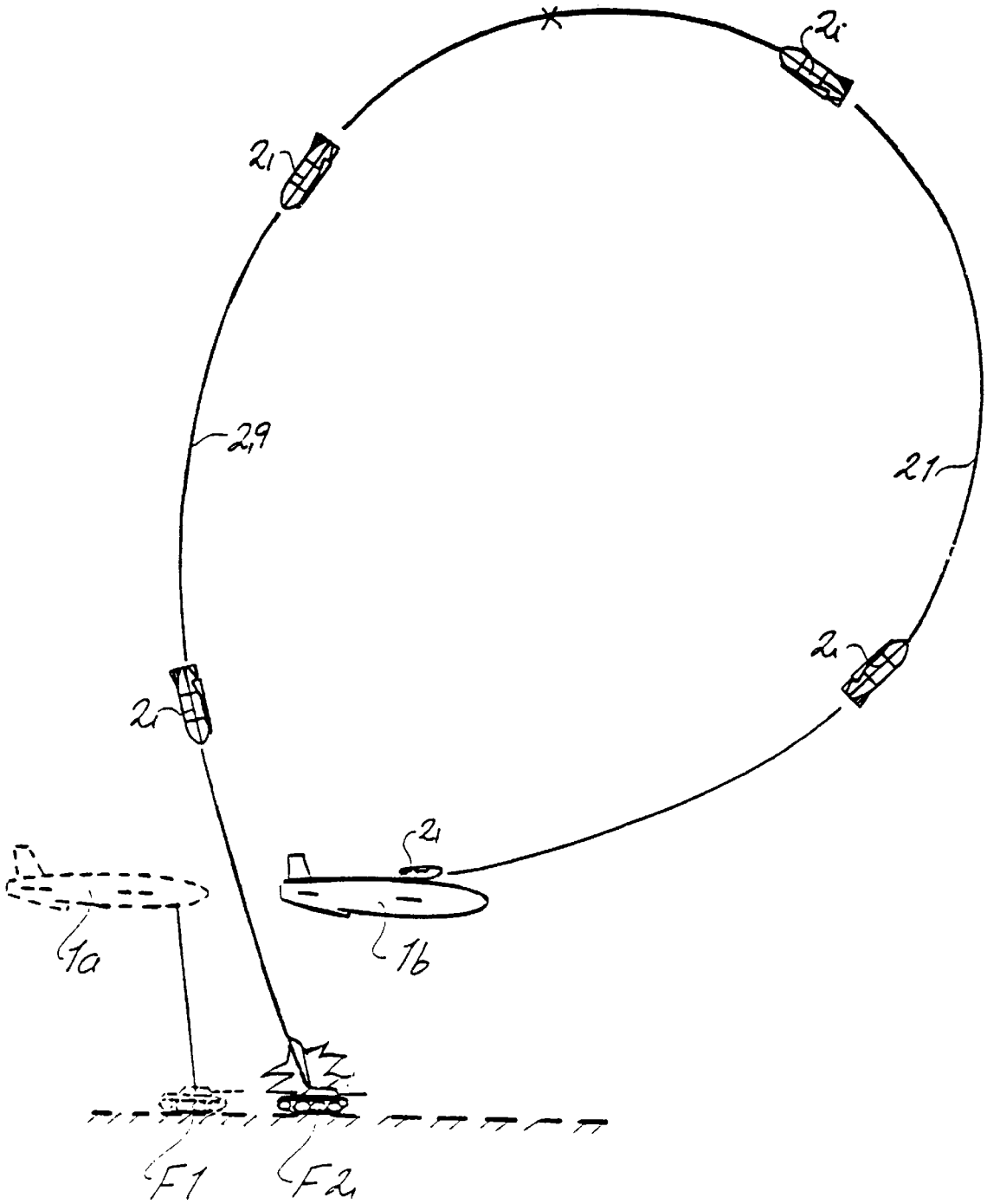

In the alternative shown in FIG. 7, the same functions as in FIGS. 5 and 6 are executed in principle up to and including the point where the warhead has passed the topmost height of the looping trajectory, after which the active target seeker of the warhead is able to take over and during the downward trajectory 29 guide the warhead, via the control logic of the warhead, directly towards the identified target F which, according to this alternative too, has thus moved from the point F1 to the point 2.

We claim:

1. A method for combating identified ground targets using warheads which can act independently after they have been launched from a launching vehicle, said launching vehicle being provided with a launching vehicle target seeker and flying close over a target area, said method comprising the steps of;

identifying a target by said launching vehicle target seeker and commanding the separation of a warhead from said launching vehicle;

separating said warhead from said launching vehicle;

after separation of said warhead from said launching vehicle, using only the kinetic energy of the launching vehicle taken over by the warhead at the separation and an aerofoil on the warhead to provide to the warhead a predetermined flight trajectory;

activating a warhead target seeker and descending said warhead with deceleration towards the ground while scanning the ground with the warhead target seeker for targets; and attacking one said target, after it has been identified by the warhead target seeker.

2. A method in accordance with claim 1 further comprising the step of;

decelerating the speed of the fall of the warhead during its dive with spin by means of deployable members.

3. An apparatus for combating identified ground targets, said apparatus comprising;

a launching vehicle;

a warhead intended to be launched from said launching vehicle over a target area;

an operational unit within said launching vehicle collecting data of possible targets within said target area and based on said data deciding and initiating the launching of the warhead;

an aerodynamically shaped aerofoil covering said warhead during at least a first part of its flight after it has been launched from the launching vehicle, said aerofoil being so designed that when said warhead is launched, by using only the kinetic energy taken over by the warhead from the launching vehicle, the warhead is given a flight trajectory changing its original forward trajectory upwards and backwards to a point close to the separation point where said warhead left the launching vehicle, but at a higher altitude with respect to said launching vehicle; and a target seeker within said warhead for seeking targets after the warhead has left the launching vehicle and for initiating the warhead when said target is covered within fighting distance.

4. A device according to claim 3 further comprising;

controllable rudders on the aerofoil;

logics for controlling said aerofoil included therein; and members included in the aerofoil which, at a predetermined point on the flight trajectory, after the aerofoil's highest point has been passed, rotate the warhead up to a predetermined speed of rotation and convert the aerofoil's flight to a diving spin, rotating about its maximum inertia axis, with an angle between said axis and a scanning direction of the target seeker included therein and a direction of action of an active charge of the warhead, said scanning direction and said direction of action being parallel with each other.

5. A device according to claim 4 wherein said warhead is divided in the longitudinal direction whereby when it has executed the flight trajectory and has been given the desired rotation, it releases a submunition containing said active charge, a fuse/arming/ignition device, said target seeker, and deployable aerodynamic deceleration surfaces.

6. A method for combating identified ground targets launched from a launching vehicle, said method comprising the steps of:

identifying a target with a launching vehicle target seeker and commanding separation of a warhead from said launching vehicle;

separating said warhead from said launching vehicle;

using at least some of the kinetic energy of said launching vehicle taken over by said warhead at separation to provide said warhead with a flight trajectory changing from its original forward flight trajectory upwards and backwards towards a point close to the separation point, but at a higher altitude compared to said launching vehicle;

rotating said warhead, after it has passed a topmost point of its flight trajectory, about its main inertia axis to a predetermined speed of rotation;

dividing said warhead;

releasing a submunition from said divided warhead, said submunition being provided with decelerating members, a submunition target seeker, and ignition device;

decelerating said submunition towards the ground while rotating about its main inertia axis which is inclined relative to a direction of action of an active charge, said direction of action being parallel with a scanning direction of said submunition target seeker;

activating said submunition target seeker to scan the ground below; and activating said active charge when said target has been identified by said submunition target seeker.

7. A method according to claim 6 further comprising the steps of;

collecting through said launching vehicle target seeker information about the longitudinal and lateral position of the target with respect to the separation point for the warhead; and combining the flight trajectory of the warhead with a longitudinal and/or lateral correction in accordance with the information collected through said launching vehicle target seeker in order to provide to the warhead the most advantageous separation point for combating the target.

8. A method in accordance with claim 6 further comprising the step of;

correcting the flight trajectory of the warhead, by control logics integrated therein, for winds in the lateral and longitudinal directions, and other movements in the air stream in accordance with readings of these movements taken during the flight trajectory.

9. A method in accordance with claim 6 further comprising the steps of:

causing the warhead, after it has reached the topmost height of the flight trajectory, to dive towards the ground;

thereby causing the rotation of said warhead about its own main inertia axis, which has been given a predetermined inclination relative to the direction of action of said active charge included in the warhead and said scanning direction of the submunition target seeker.

10. A method in accordance to claim 6 further comprising the steps of;

activating final phase guidance members connected to said submunition target seeker; and guiding said submunition against the target with said guidance members.

* * * * *